US008336749B2

(12) United States Patent
Largo

(10) Patent No.: US 8,336,749 B2
(45) Date of Patent: Dec. 25, 2012

(54) SINGLE SWITCHED DUAL FIRING CONDITION COMBUSTION NAILER

(75) Inventor: Marc Largo, Gurnee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 411 days.

(21) Appl. No.: 12/415,271

(22) Filed: Mar. 31, 2009

(65) Prior Publication Data

US 2010/0243699 A1 Sep. 30, 2010

(51) Int. Cl.
*B27F 7/05* (2006.01)

(52) U.S. Cl. ..... 227/10; 227/130; 227/2; 123/46 SC

(58) Field of Classification Search ..... 227/10, 227/130, 2; 123/46 SC
See application file for complete search history.

(56) References Cited

U.S. PATENT DOCUMENTS

| | | | | |
|---|---|---|---|---|
| 4,403,722 | A | 9/1983 | Nikolich | |
| 4,483,473 | A | 11/1984 | Wagdy | |
| 4,483,474 | A | 11/1984 | Nikolich | |
| 4,522,162 | A | 6/1985 | Nikolich | |
| RE32,452 | E | 7/1987 | Nikolich | |
| 5,197,646 | A | 3/1993 | Nikolich | |
| 5,263,439 | A | 11/1993 | Doherty et al. | |
| 6,145,724 | A | 11/2000 | Shkolnikov et al. | |
| 6,783,045 | B2 * | 8/2004 | Shima et al. | 227/8 |
| 7,163,134 | B2 | 1/2007 | Moeller et al. | |
| 7,284,511 | B2 * | 10/2007 | Zahner et al. | 123/46 H |
| 7,444,963 | B2 * | 11/2008 | Tanaka | 123/46 SC |
| 7,467,739 | B2 * | 12/2008 | Fujisawa et al. | 227/10 |
| 7,854,360 | B2 * | 12/2010 | Suda | 227/2 |
| 2006/0065690 | A1 | 3/2006 | Fujisawa et al. | |

OTHER PUBLICATIONS

Senco, GT9OCH / GT9OFRH Cordless Framing Nailer, Oct. 29, 2007, pp. 1-24.

* cited by examiner

*Primary Examiner* — Brian D Nash
*Assistant Examiner* — Michelle Lopez
(74) *Attorney, Agent, or Firm* — Greer, Burns & Crain, Ltd.; Patty Chidiac; Mark W. Croll

(57) ABSTRACT

A combustion tool is provided, including a combustion power source with a reciprocating valve sleeve moving between a rest position in which a combustion chamber is open, and a closed position in which the combustion chamber is sealed, a control system operatively connected to the power source, and a trigger switch connected to the control system and providing operator interface with the control system. The control system is configured such that operator manipulation of the trigger switch is the only operator initiated movement required for initiating repetitive spark generation.

17 Claims, 5 Drawing Sheets

SINGLE SWITCHED DUAL FIRING CONDITION COMBUSTION NAILER

BACKGROUND

The present invention relates generally to fastener-driving tools, and more specifically to such tools operating under combustion power, also referred to as combustion nailers.

Combustion nailers are known in the art, and one type of such tools, also known as IMPULSE® brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 6,145,724, all of which are incorporated by reference herein. Similar combustion-powered nail and staple driving tools are available commercially from ITW-Paslode of Vernon Hills, Ill. under the IMPULSE®, BUILDEX® and PASLODE® brands.

Such tools incorporate a tool housing enclosing a power source in the form of a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. The engine includes a reciprocating piston with an elongated, rigid driver blade disposed within a single cylinder body.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original or pre-firing position through differential gas pressures within the cylinder. Fasteners are fed magazine-style into the nosepiece, where they are held in a properly positioned orientation for receiving the impact of the driver blade.

A valve sleeve is axially reciprocable about the cylinder and, through a linkage, moves to close the combustion chamber when a work contact element (WCE) at the end of the linkage is pressed against a workpiece. This pressing action also triggers a fuel-metering valve to introduce a specified volume of fuel into the closed combustion chamber.

Combustion-powered tools now offered on the market are sequentially operated tools. The tool must be pressed against the workpiece, collapsing the WCE before the trigger is pulled for the tool to fire a nail. The distinguishing feature that limits combustion-powered tools to sequential operation is the operator's manual control of the valve sleeve via a lockout mechanism that is linked to the trigger. This mechanism holds the combustion chamber closed until the operator releases the trigger, thus taking into account the operator's relatively slow musculature response time. In other words, the physical release of the trigger consumes enough time of the firing cycle to assure piston return. It is disadvantageous to maintain the chamber closed longer than the minimum time to return the piston, as cooling and purging of the tool is prevented.

In conventional combustion nailers, two electrical switches are required to obtain combustion-causing ignition. A first switch is referred to as a chamber switch or a head switch, and is closed when the reciprocating valve sleeve moves to seal the combustion chamber, through action of the WCE. To close the chamber switch, the tool is pressed against a workpiece where the fastener is desired. The second switch is the trigger switch, manipulated by the operator, which actually initiates the spark that generates combustion.

Combustion nailers are desired to be operable in at least one of two firing conditions. A first firing condition is called sequential, in that the chamber switch must be closed before the trigger switch can be pulled. A second firing condition is called repetitive, in which the user holds the trigger closed for an extended period of time, and ignition is initiated each time the chamber switch is closed. Repetitive firing is useful when a rapid rate of fastener application is desired. In either condition, one or both of the switches control other tool functions, such as a fan motor and/or solenoids for injecting fuel or maintaining the combustion chamber closed until the piston/driver blade returns to the pre-firing position.

SUMMARY

The present tool features a single switch manipulated by the operator for controlling an ignition source which generates repeated pulsing sparks at a predetermined rate as long as the operator is manipulating the switch in the energized position. In addition, the single switch also activates a fan motor for facilitating fuel mixing, scavenging, and in a first embodiment for energizing a lockout device for preventing the combustion chamber from opening prematurely after combustion before the piston returns. In a second embodiment, a combustion chamber control device is energized simultaneously with the pulling of the trigger. However, the combustion chamber is not controlled until the combustion chamber is closed.

In the present tool, the user alternates between sequential and repetitive firing conditions without any special manipulation. When sequential operation is desired, the operator will depress the tool against the work surface, closing the combustion chamber and introducing fuel. Next, the operator pulls the trigger which will turn on the fan, start ignition pulsing and, in one embodiment, power the combustion chamber control or lockout device. A microprocessor times tool cycle events so that the fan motor starts ahead of the ignition pulsing. After ignition, power and piston return, timing will be such that the combustion chamber control device is de-energized and the combustion chamber is allowed to open.

When the nailer is desired to be used in a repetitive firing condition, the operator manipulates the trigger first, which initiates the same actions as in the sequential condition, i.e., fan on, ignition pulse on. When the operator manipulates the tool against the work surface, the combustion chamber is closed and the fuel is introduced. The fan already turning will rapidly mix air in the combustion chamber with the fuel and as soon as a combustible mixture is formed, and the pulsing spark will initiate combustion. When the operator lifts the tool from the work surface, the combustion chamber will be held closed by the combustion chamber control device. This device, in the preferred embodiment, is controlled by a microprocessor and its operation is timed as necessary to accomplish sufficient holding duration. As an option, regardless of the firing condition, the combustion chamber control device is operable simultaneously with a trigger pull or upon sensing the piston reaching the end of travel.

More specifically, a combustion tool is provided, including a combustion power source with a reciprocating valve sleeve moving between a rest position in which a combustion chamber is open, and a closed position in which the combustion chamber is sealed, a control system operatively connected to the power source, and a trigger switch connected to, and providing operator interface with the control system. The control system is configured such that operator manipulation of the trigger switch is the only operator initiated movement required for initiating repetitive spark generation.

In another embodiment, a combustion-powered fastener-driving tool includes a combustion-powered power source, a workpiece contact element reciprocable relative to the power source between a rest position and a firing position, the workpiece contact element connected to a valve sleeve associated with the power source and being movable between an open position and a closed position, a control system operationally associated with the power source, and a trigger switch connected to, and providing operator interface with the control system. The control system is configured so that upon a user manipulating the trigger switch, multiple sparks are generated in the power source during the driving of a single fastener.

DETAILED DESCRIPTION

Figure 1:
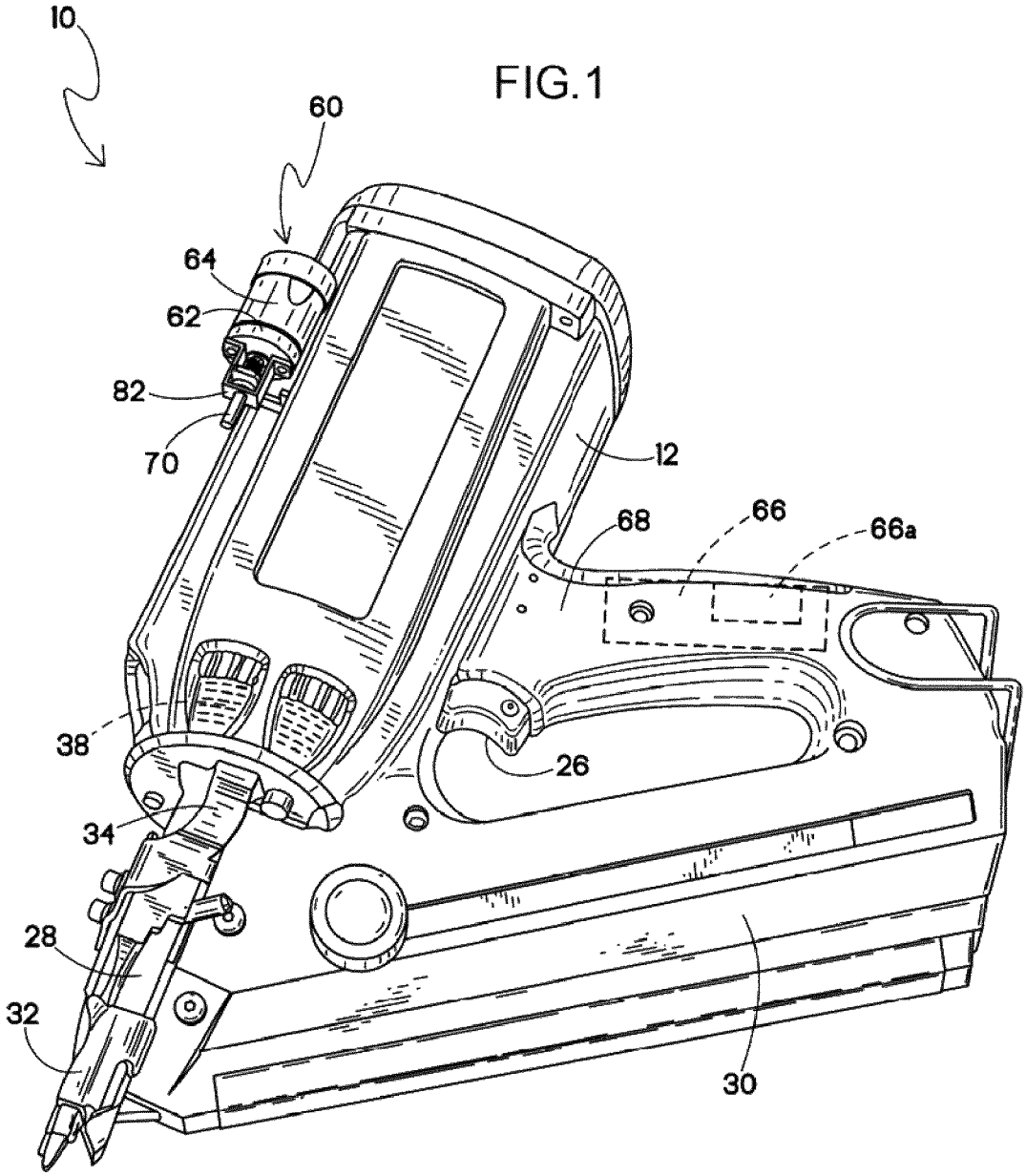
FIG. 1 is a top perspective view of a combustion nailer equipped with the present invention.
Figure 2:
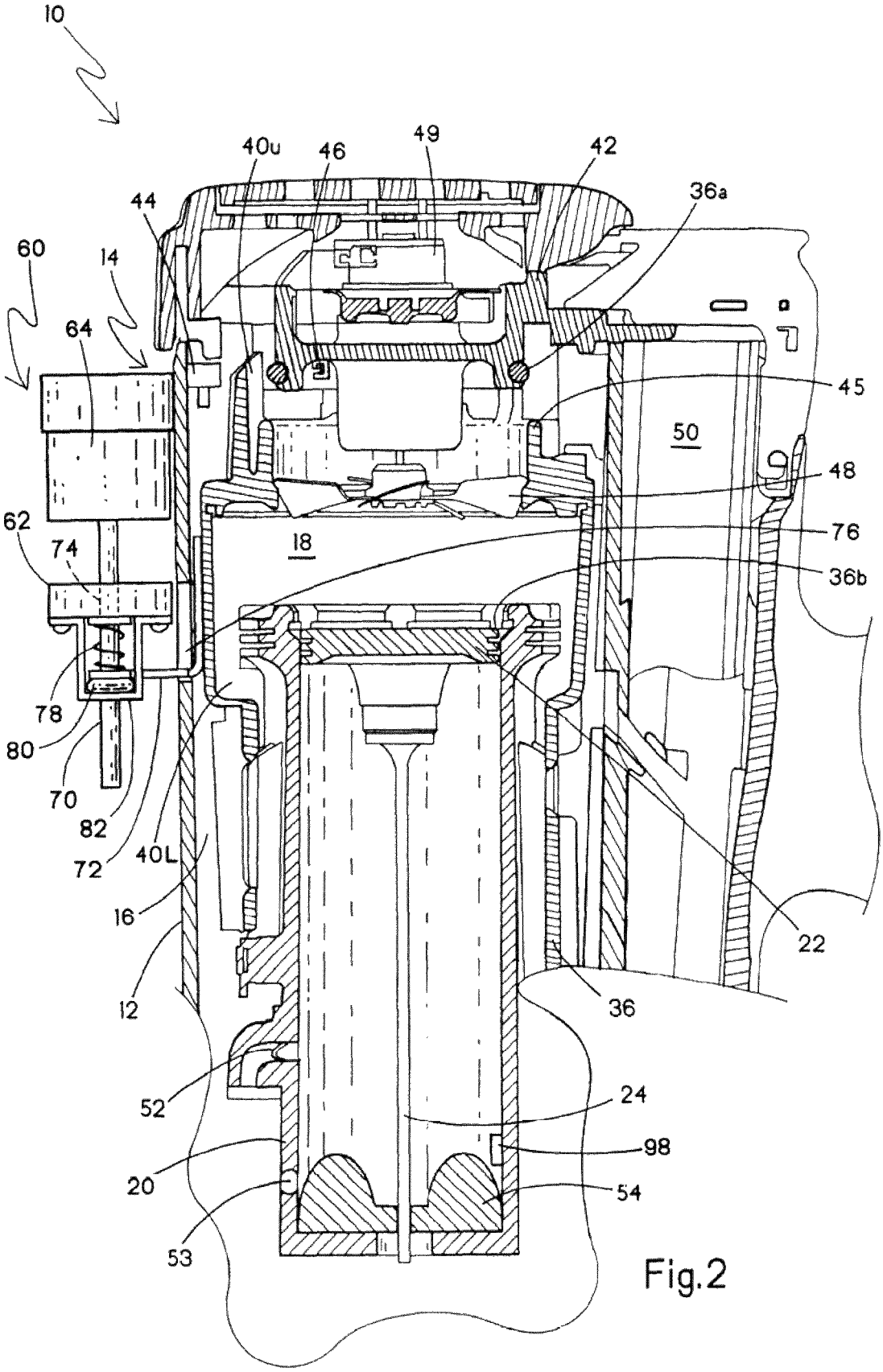
FIG. 2 is a fragmentary vertical section of the tool of FIG. 1.

Referring now to FIGS. 1 and 2, a combustion-powered fastener-driving tool incorporating the present invention is generally designated 10 and preferably is of the general type described in detail in the patents listed above and incorporated by reference in the present application. A housing 12 of the tool 10 encloses a self-contained internal power source 14 (FIG. 2) within a housing main chamber 16. As in conventional combustion tools, the power source 14 is powered by internal combustion and includes a combustion chamber 18 that communicates with a cylinder 20. A piston 22 reciprocally disposed within the cylinder 20 is connected to the upper end of a driver blade 24. As shown in FIG. 2, an upper limit of the reciprocal travel of the piston 22 is referred to as a pre-firing position, which occurs just prior to firing, or the ignition of the combustion gases which initiates the downward driving of the driver blade 24 to impact a fastener (not shown) to drive it into a workpiece.

The operator induces combustion within combustion chamber 18 through depression of a trigger or trigger switch 26 causing the driver blade 24 to be forcefully driven downward through a nosepiece 28 (FIG. 1). The nosepiece 28 guides the driver blade 24 to strike a fastener that had been delivered into the nosepiece via a fastener magazine 30.

Included in proximity to the nosepiece 28 is a workpiece contact element 32, which is connected, through a linkage 34 to a reciprocating valve sleeve 36, an upper end of which partially defines the combustion chamber 18. Depression of the tool housing 12 against the workpiece in a downward direction as seen in FIG. 1 (other operational orientations are contemplated as are known in the art), causes the WCE 32 to retract relative to the nosepiece 28 and to move from a rest position to a firing position. This movement overcomes the normally downward biased orientation of the workpiece contact element 32 caused by a spring 38 (shown hidden in FIG. 1).

Through the linkage 34, the workpiece contact element 32 is connected to and reciprocally moves with, the valve sleeve 36. In the rest position (FIG. 2), the combustion chamber 18 is not sealed, since there are annular gaps 40, more specifically an upper gap 40U separating the valve sleeve 36 and a cylinder head 42 which accommodates a spark plug 46, and a lower gap 40L separating the valve sleeve 36 and the cylinder 20. In the preferred embodiment of the present tool 10, the cylinder head 42 also is the mounting point for a cooling fan 48 and an associated fan motor 49 powering the cooling fan. In the rest position depicted in FIG. 2, the tool 10 is disabled from firing because the valve sleeve 36 is not sealed with the cylinder head 42 or with the cylinder 20.

Firing is enabled when an operator presses the workpiece contact element 32 against a workpiece. This action overcomes the biasing force of the spring 38, causes the valve sleeve 36 to move upward relative to the housing 12, closing the gaps 40U and 40L and sealing the combustion chamber 18. This operation also induces a measured amount of fuel to be released into the combustion chamber 18 from a fuel canister or fuel cell 50 (shown in fragment).

Upon a pulling of the trigger 26, the spark plug 46 is energized, igniting the fuel and air mixture in the combustion chamber 18 and sending the piston 22 and the driver blade 24 downward toward the waiting fastener for entry into the workpiece. As the piston 22 travels down the cylinder, it pushes a rush of air which is exhausted through at least one petal or check valve 52 and at least one vent hole 53 located beyond the piston displacement (FIG. 2). At the bottom of the piston stroke or the maximum piston travel distance, the piston 22 impacts a resilient bumper 54 as is known in the art. With the piston beyond exhaust check valve 52, high pressure gases vent from cylinder 20 until near atmospheric pressure conditions are obtained and the check valve 52 closes. After ignition and fastener driving, due to internal pressure differentials in the cylinder 20, the piston 22 is drawn back to the pre-firing position shown in FIG. 2.

One of the issues confronting designers of combustion-powered tools of this type is the need for a consistent return of the piston 22 to the pre-firing position and improved chamber 18 control prior to the next cycle. This need is especially critical if the tool is to be fired in a repetitive firing condition, where an ignition occurs each time the workpiece contact element 32 is retracted, and during which time the trigger 26 is continually held in the pulled or squeezed position.

Referring now to FIGS. 1 and 2, to accommodate these design concerns, the present tool 10 preferably incorporates a combustion chamber control or lockout device, generally designated 60 and configured for preventing the reciprocation of the valve sleeve 36 from the closed or firing position until the piston 22 returns to the pre-firing position. This holding or locking function of the control device 60 is operational for a specified period of time required for the piston 22 to return to the pre-firing position. Thus, the operator using the tool 10 can rapidly lift the tool from the workpiece where a fastener was just driven, and begin to reposition the tool for the next firing cycle. Due to the shorter firing cycle times inherent with repetitive cycle operation, the lockout device 60 ensures that the combustion chamber 18 will remain sealed, and the differential gas pressures maintained so that the piston 22 will be returned before premature opening of the chamber 18, which would interrupt piston return.

While a preferred embodiment of a lockout control device 60 is described in further detail in US Patent Publication No. 2007/0131731A published Jun. 14, 2007, incorporated by reference herein and summarily described below, it will be understood that other types of lockout control devices, whether electronic or mechanical, may be provided for preventing the opening of the combustion chamber 18 for a specified period of time considered adequate for consistent piston return. Such lockout or delay devices are especially needed for tools capable of repetitive cycle operation, where the operator has the potential for defeating conventional piston return cycle mechanisms by removing the tool from the workpiece between combustion firings before the piston has a chance to return to the pre-firing position.

The combustion chamber control device 60 is configured for acting to limit the movement of the valve sleeve 36 for a predetermined period along an axis parallel to the movement of the valve sleeve. Accordingly, the lockout mechanism 60 includes a magnetic plate 62 associated with the valve sleeve 36 that prevents the valve sleeve from movement away from the cylinder head 42 to open the combustion chamber 18 when an electromagnetic device 64 is energized. Attached to the housing 12, the electromagnetic device 64 is controlled by a control system 66 having a control program 66*a*. While other locations are contemplated, the control system 66 is located in a handle portion 68 of the housing 12. The electromagnetic device 64 is provided with a depending alignment shaft 70. When the electromagnetic device 64 is energized, the magnetic plate 62 is configured for being magnetically attracted to and held in place, and is provided with a throughbore 74 (shown hidden) which matingly engages the alignment shaft 70.

A generally "L" shaped bracket 72 is preferably attached to the valve sleeve 36, and has an aperture (not shown) for engaging the alignment shaft 70. The housing 12 has a slot 76 dimensioned for accommodating the travel of the valve sleeve 36 from the rest position (FIG. 2) to the pre-firing position. A biasing element 78 such as a compression spring or the like is positioned on the alignment shaft 70 beneath the magnetic plate 62.

A dampening element 80 such as a resilient doughnut-shaped rubber bushing or the like is disposed on the alignment shaft 70 and is held in place by a generally "U"-shaped retainer bracket 82 secured to the magnetic plate 62. Thus, once energized, the control system 66, through the electromagnetic device 64 secures the valve sleeve 36 in place. As such, the combustion chamber 18 is prevented from opening after a combustion event so that sufficient time is provided for the piston 22 to return to the pre-combustion position of FIG. 2.

Figure 3:
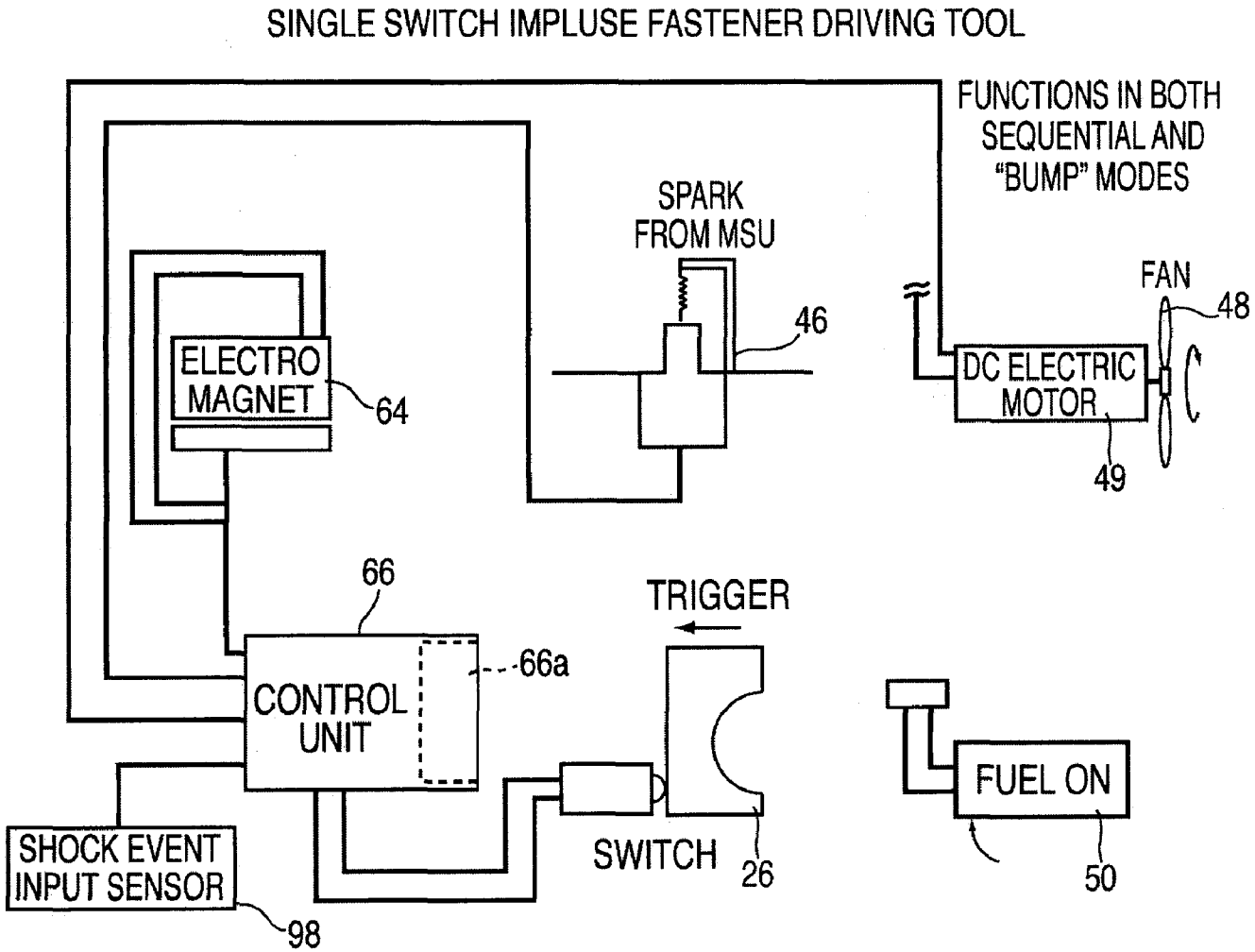
FIG. 3 is a schematic view of the control system of the present tool.
Figure 4:
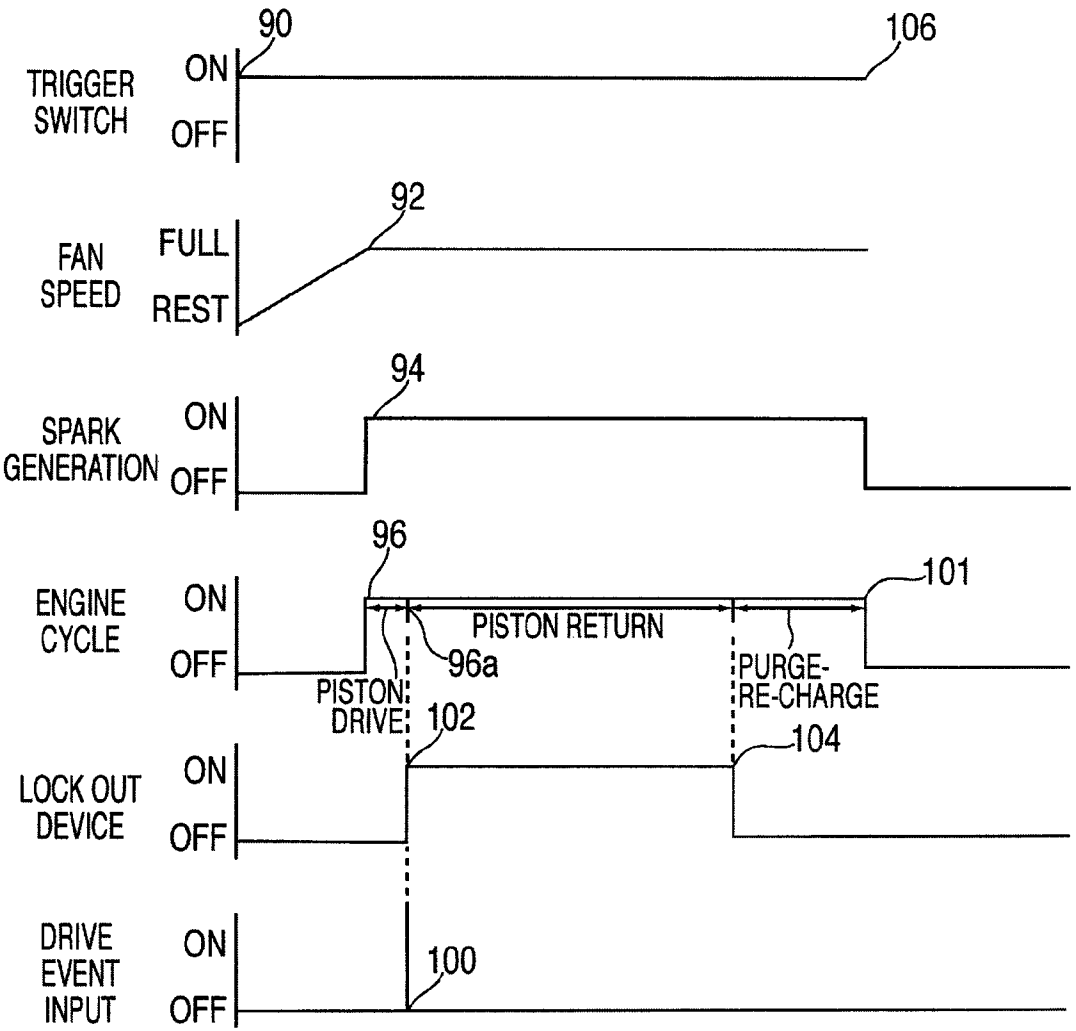
FIG. 4 is a timing chart of the present tool operating in a first embodiment.
Figure 5:
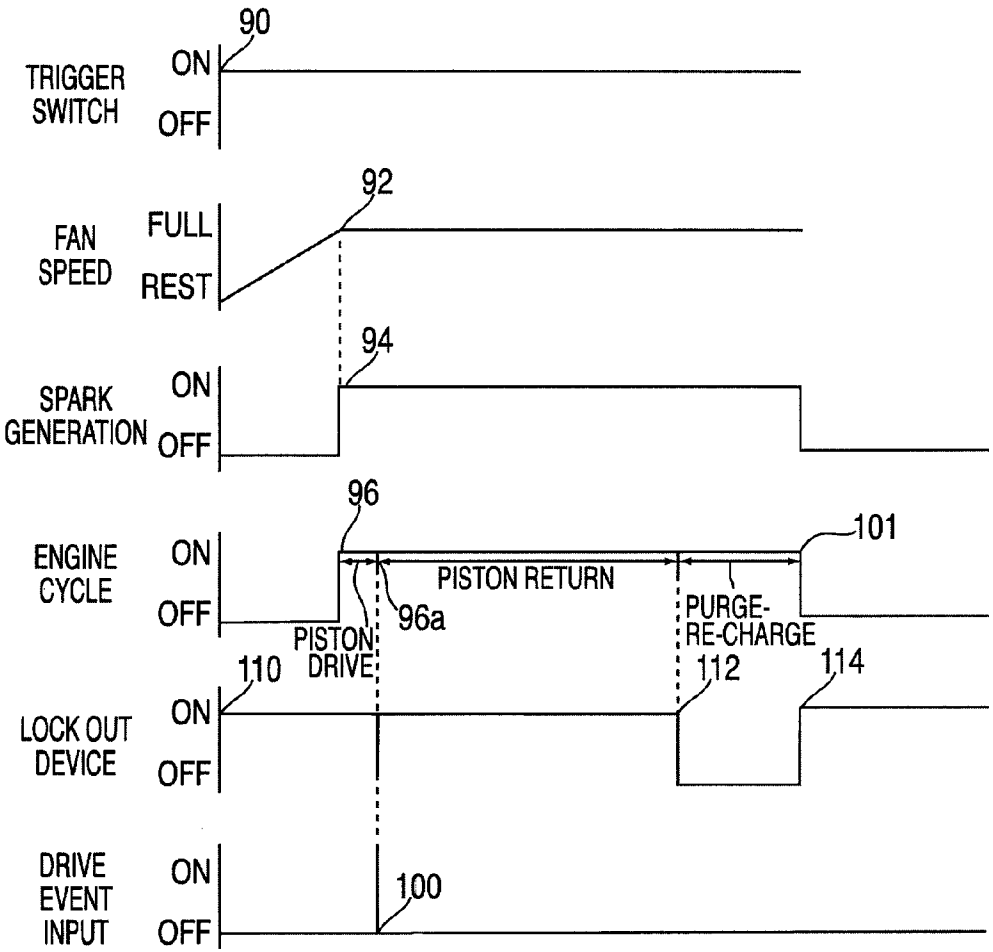
FIG. 5 is a timing chart of the present tool operating in a second embodiment.

Referring now to FIGS. 3-5, an important feature of the present tool 10 is that the trigger switch 26 is connected to the control system 66 and provides the only active operator interface with the control system. This is because the control system 66 is configured such that operator manipulation of the trigger switch is the only operator initiated control movement required for initiating spark generation. In contrast to conventional combustion tools, the present tool 10 lacks a chamber or head switch. Thus, in the present tool, the control system 66 is configured such that the firing condition is varied independent of the position of the valve sleeve 32.

As seen in FIG. 3, the trigger switch 26 is connected to the control system 66 represented by a microprocessor, as are the fan motor 49, the spark plug 46 and the electromagnetic device 64. Fuel is dispensed from the fuel cell 50 through actuation of the WCE 32, activating a mechanical linkageas is known in the art. In the present tool 10, the manner in which the operator uses the tool in conjunction with the activation of the trigger switch 26 will determine whether the tool is operating in the sequential fire condition or in the repetitive fire condition.

Referring now to FIG. 4, once the user picks up the tool 10, if the tool is pressed against the workpiece, through the action of the WCE 32 connected to internal tool mechanical linkage, fuel will be introduced into the combustion chamber 18. Once the trigger switch 26 is pulled at 90, the fan motor 49 will be energized, and a specified delay will be allowed at 92 until the fan 48 is operating at full operational speed. At the same time, at 94, once the fan 48 is at full speed, the control system 66 causes the spark plug 46 to begin repetitive spark generation or continuous pulsing at a predetermined rate as long as the operator continues to hold/squeeze the trigger switch 26. In other words, multiple sparks are generated in the power source 14 during the driving of a single fastener.

Upon the spark generation, the fuel in the combustion chamber 18 is ignited, beginning an engine cycle at 96 which lasts until the piston 22 returns to the pre-firing position. During the cycle, the piston 22 travels down the cylinder 20 until it impacts the bumper 54, seen at 96*a*. In the course of this travel, the driver blade 24 impacts and drives a fastener into the workpiece as is known in the art.

A sensing device 98 (FIG. 2), such as an accelerometer or other type of shock event input sensor, such as, a pressure sensor, temperature sensor or other sensor configured for monitoring combustion nailer drive events, is disposed near the bumper 54 (FIG. 2) to detect movement of the piston 22 or the resulting impact and is connected to the control system 66. In one embodiment, an accelerometer chip in a control device board of the control system 66 or external to the control system senses the piston 22 impacting the bumper 54 at the end of its stroke. After the piston 22 impacts the bumper 54, it takes approximately 60 msec. for the piston to return to the pre-firing position. That is the preferred period in which the electromagnetic device 64 is energized, however other durations are contemplated depending on the application. The sensing device 98 alternately senses the initial acceleration (tool lifting) while the piston 22 is descending. As a safety, the ignition pulsing is timed by the control device 66 such as a microprocessor to stop after a period of time if the sensing device 98 does not sense a combustion event. The operator then releases and remanipulates the trigger to resume firing. Upon receiving a signal from the sensing device 98 of significant piston movement, piston bottoming out due to impact at the bumper 54, at 100 in FIG. 4, occurring slightly after the ignition, the electromagnetic device 64 is turned on or energized at 102, holding the valve sleeve 36 in the closed position. In this context, "energized" means sufficiently energized so that, if in sufficiently close proximity to the electromagnetic device 64, the valve sleeve 36 is held in position by the electromagnetic device.

The electromagnetic device 64 holds the combustion chamber 18 closed by holding the valve sleeve 36 in place a predetermined period of time to ensure that the piston 22 returns to the pre-firing position. At the expiration of the predetermined period, at 104, the electromagnetic device 64 is deenergized by the control system 66, and the combustion chamber 18 opens for exhaust or purge, cooling and recharge of air. Depending on whether sequential or repetitive operation is selected, the operator may or may not release the trigger switch 26 after the fastener has been driven, and moves the tool 10 to the next fastener location. For the next and subsequent fasteners driven in the sequential firing condition, the above process is then repeated, with the exception that there is no fan delay 92, since the fan 48 is at operational speed.

It should be noted that the spark pulsing continues as long as the trigger switch 26 is pulled, and ends at 106 when the operator releases the trigger switch. It is also contemplated that the control system 66 is configured such that when the fan 48 is disabled, as through malfunction or through the expiration of a time out function of the program 66*a*, the spark pulsing is also disabled. Alternatively, the control program

66*a* is configurable so that after initiation of spark pulsing, the lack of a drive event input at 100 within a specified period of time disables the spark pulsing. Yet another alternative is that spark pulsing may be suspended to save energy after a drive event input 100, such as during piston return and/or purging/recharge at 101. It is further contemplated that the spark pulsing may be controlled directly from the control program 66*a* as through a timing routine. Once spark pulsing is disabled, the firing sequence needs to be restarted from the beginning for tool operation.

Referring now to FIG. 5, operation in an alternate control embodiment is graphically illustrated. A main feature of this condition is that the combustion chamber control device 60 is energized upon the user activating or pulling the trigger switch 26, as seen at 110. Despite the fact that the electromagnetic device 64 is energized, it will not lock the combustion chamber 18 until the valve sleeve 36 reaches the closed position, which occurs when the tool 10 is pressed against a workpiece, as is known in the art. In the preferred embodiment, since the device 64 is an electromagnet, it only holds the combustion chamber closed when the valve sleeve 36 is in close enough proximity to be held by the magnetic forces generated by the device.

After combustion or the beginning of an engine cycle at 96, the combustion chamber control device 60 maintains the combustion chamber 18 in a locked condition until the expiration of a predesignated time period, determined by the control system 66 to permit proper return of the piston 22. At the expiration of the time period, at 112, the combustion chamber control device 60 is deenergized, allowing the combustion chamber 18 to open for exhaust purging and recharging. The device 60 is then reenergized at 114 at the expiration of a sufficient predesignated deenergization period to await the next engine cycle.

It will be seen that an advantage of the present tool 10 is the configuration of the control system 66 such that the tool generates combustion cycles in a selected one of a sequential firing condition and a repetitive firing condition based solely upon routine manipulation of the trigger switch. Also, the control system is configured such that both firing conditions are allowed independent of any sensed position of the valve sleeve 36. Thus, the present tool offers the ability to operate in the same manner after the first trigger pull or manipulation, regardless of whether the tool is in the sequential or repetitive firing condition, thus reducing parts, lowering manufacturing costs and simplifying tool operation. Also, tool failures due to malfunctioning chamber switches are eliminated.

While a particular embodiment of the present single switched dual firing condition nailer for a combustion-powered fastener-driving tool has been described herein, it will be appreciated by those skilled in the art that changes and modifications may be made thereto without departing from the invention in its broader aspects and as set forth in the following claims.

What is claimed is:

1. A combustion tool, comprising:

a combustion power source including a reciprocating valve sleeve moving between a rest position in which a combustion chamber is open, and a closed position in which said combustion chamber is sealed;

a control system operatively connected to said power source;

a trigger switch connected to said control system and providing operator interface with said control system;

said control system being configured to cause a generation of multiple sparks in said power source for initiating combustion in said power source for the driving of a single fastener solely upon operator manipulation of said trigger switch and regardless of whether said valve sleeve is in the closed position.

2. The tool of claim 1 wherein said control system is configured to, upon a single manipulation of said trigger switch, cause an initiation of repetitive ignition firings.

3. The tool of claim 2 wherein said initiation of said repetitive ignition firings occurs simultaneous with a fan motor associated with said power source reaching a designated operational speed.

4. The tool of claim 2 wherein said control system is configured for causing operation of said tool in one of a sequential firing condition and a repetitive firing condition.

5. The tool of claim 2 wherein said control system is configured to cause the initiation of said repetitive firings prior to said valve sleeve reaching said closed position.

6. The tool of claim 1 wherein said control system is configured to cause a delay between said manipulation of said trigger switch and said spark generation.

7. The tool of claim 1 wherein said control system is configured to control at least one tool function of fan motor operation, fuel injection operation, and combustion chamber control device operation, and wherein said control system is configured to cause an initiation of said at least one tool function solely upon said manipulation of said trigger switch.

8. The tool of claim 1 further including a combustion chamber control device for holding said valve sleeve in said closed position for a predetermined period of time, and a sensing device for measuring movement of a piston for triggering operation of said control device, said control device and said sensing device being connected to said control system.

9. The tool of claim 8 wherein said said control system is configured to cause the combustion chamber control device to turn on when said sensing device senses said piston reaching a bottom out position.

10. The tool of claim 8 wherein said control system is configured to cause said spark generation to be disabled when said sensing device fails to sense piston movement within a specified period of time.

11. The tool of claim 8 further including a fan disposed in said combustion chamber and being controlled by said control system, wherein said control system is configured to cause said spark generation to be disabled when said fan is disabled.

12. The tool of claim 1 further including a combustion chamber control device configured to be energized upon manipulation of said trigger switch.

13. A combustion-powered fastener-driving tool, comprising:

a combustion-powered power source;

a workpiece contact element reciprocable relative to said power source between a rest position and a firing position, said workpiece contact element connected to a valve sleeve associated with said power source and being movable between an open position and a closed position;

a control system operationally associated with said power source;

a trigger switch connected to, and providing operator interface with said control system;

said control system being configured to cause a generation of multiple sparks upon a user manipulating said trigger switch, said multiple sparks being generated in said power source during the driving of a single fastener regardless of whether said valve sleeve is in the closed position.

14. The tool of claim 13 further including a combustion chamber control device provided for holding said valve sleeve in said closed position for a predetermined period of time, and an accelerometer for measuring movement of a piston for triggering operation of said control device, said control device and said accelerometer being connected to said control system.

15. The tool of claim 14, wherein said control system is configured so that said spark generation is temporarily terminated when no piston movement is sensed by said accelerometer for a specified period of time.

16. The tool of claim 14, wherein said control device is energized upon pulling of said trigger switch, but is activated only upon said valve sleeve reaching said closed position.

17. A combustion tool, comprising:

a power source including a reciprocating valve sleeve;

a control system operatively connected to said power source and configured for operating said tool in one of a sequential firing condition and a repetitive firing condition;

a trigger switch connected to, and providing operator interface with said control system;

said control system being configured to cause a generation in said tool of ignition in a selected one of said sequential firing condition and said repetitive firing condition based solely upon manipulation of said trigger switch and regardless of whether said valve sleeve is in a closed position.

* * * * *